US006209469B1

(12) United States Patent
Burton et al.

(10) Patent No.: US 6,209,469 B1
(45) Date of Patent: Apr. 3, 2001

(54) APPARATUS AND PROCESS FOR PRODUCING PILLOW SHAMS

(76) Inventors: Perry E. Burton, deceased, late of Marietta, SC (US); by Lois LaBoone, executor, 217 Marked Beech Rd., Marietta, SC (US) 29661; by John V. Noonan, executor, 106 Merrifield Ct., Greenville, SC (US) 29615

( * ) Notice: Subject to any disclaimer, the term of this patent is extended or adjusted under 35 U.S.C. 154(b) by 0 days.

(21) Appl. No.: 09/437,188

(22) Filed: Nov. 9, 1999

Related U.S. Application Data

(60) Provisional application No. 60/107,618, filed on Nov. 9, 1998.

(51) Int. Cl.[7] ..... D05B 13/00; D05B 27/00

(52) U.S. Cl. ..... 112/475.06; 112/475.08; 112/10; 112/63

(58) Field of Search ..... 112/10, 63, 470.29, 112/470.33, 147, 122, 475.06, 475.03, 475.07, 475.08

(56) References Cited

U.S. PATENT DOCUMENTS

| | | | | |
|---|---|---|---|---|
| 3,094,083 | * | 6/1963 | Weeks | 112/10 X |
| 4,370,936 | * | 2/1983 | Moyer et al. | 112/63 X |
| 4,856,439 | * | 8/1989 | O'Neal et al. | 112/470.36 X |
| 6,058,863 | * | 5/2000 | Stewart et al. | 112/475.06 X |
| 6,082,281 | * | 6/1963 | Root et al. | 112/470.07 X |

* cited by examiner

*Primary Examiner*—Ismael Izaguirre
(74) *Attorney, Agent, or Firm*—Dority & Manning, P.A.

(57) ABSTRACT

An apparatus and method are provided for converting one or more rolls of material into a pillow sham. In one embodiment, three rolls of material are overlapped and fed to a sewing and cutting system. The materials are sewn along their vertical edges and then cut to a determined size. After being cut, the three pieces of fabric are shifted and fed to further sewing heads for sewing the horizontal edges in producing a pillow sham. In an alternative embodiment of the invention, the system converts a single roll of material into a pillow sham.

21 Claims, 4 Drawing Sheets

APPARATUS AND PROCESS FOR PRODUCING PILLOW SHAMS

RELATED APPLICATION

The present application is based on a provisional patent application filed on Nov. 9, 1998 having Ser. No. 60/107,618.

FIELD OF THE INVENTION

The present invention generally relates to a method and apparatus for producing sewn products from a plurality of rolls of material. More particularly, the present invention is directed to an apparatus and process for automatically forming pillow shams. The pillow shams can be made from various plies of material and can be quilted if desired.

BACKGROUND OF THE INVENTION

A pillow sham generally refers to an ornamental covering for a bed pillow. In recent years, the popularity of pillow shams has increased. For instance, it is now popular for comforters to be sold in combination with matching pillow shams and curtains in order to tie the decorative features of a bedroom together.

Split back pillow shams generally include a face fabric attached to two overlapping plies of backing fabric. A pillow can be inserted and removed from the sham through an opening located where the two plies of backing fabric overlap. Because the plies of fabric overlap, the pillow remains secured within the sham.

Currently, split back pillow shams are made in several separate steps. For instance, typically the face fabric and the two overlapping backing fabrics are first cut to an appropriate size. Once cut, each of the two backing fabrics are hemmed along an edge where the fabrics are intended to overlap. Next, the three fabric pieces are assembled and sewn together. Once sewn, the sham is then turned right side out and further enhanced if desired.

The above process is typically done manually. Specifically, each step is usually done separately by an individual working at a cutting and sewing station.

Due to the amount of time and expense involved in producing pillow shams according to the above process, it would be desirable if a machine could be developed that could automatically form pillow shams from one or more rolls of material.

SUMMARY OF THE INVENTION

The present invention recognizes and addresses the foregoing disadvantages, and others of prior art constructions and methods.

Accordingly, it is an object of the present invention to provide an apparatus and process for producing sewn products, such as pillow shams.

Another object of the present invention is to provide an automated process for producing pillow shams.

These and other objects of the present invention are achieved by providing an apparatus designed to receive one or more rolls of material. For instance, in one embodiment, three plies of fabric are fed to the apparatus. The plies can include a face fabric and two overlapping back panels for producing a pillow sham.

More particularly, the face fabric can be fed to the apparatus such that the two overlapping back panels are superimposed upon the face fabric. The apparatus can include various tension control devices so that the fabrics are fed through the system under constant tension and in a manner so that the fabrics feed together uniformly.

As the fabrics are fed through the system of the present invention, various edges of the different fabric sheets are folded and sewn by a hem forming device. In particular, hems are formed into the edges of the back panels, where the back panels overlap to form the pillow sham. Once folded and formed, the hems are sewn together as the different plies of fabric are fed through appropriate sewing devices.

After the hems are formed on the back panels and sewn, the verticle edges of the fabric plies (which are the outside edges on a fabric roll) are sewn together. More particularly, one back panel is sewn to the face fabric along a first outside edge, while the other back panel is sewn to the face fabric along a second and opposite outside edge.

Next, the fabrics are fed to a cutting table, where the fabrics are cut to a particular size. The cutting table includes a cloth puller which is movably suspended above a table. The cloth puller moves from the downstream end of the cutting table to adjacent a cutting edge for gripping a common edge of the fabrics in order to pull the fabrics over the table. Once the fabrics are pulled over the table, the cutting edge makes a transverse cut.

Once cut to a particular size, the fabrics are shifted 90° by a conveyor towards a pair of opposing sewing heads. The sewing heads stitch together the remaining edges of the fabric product (the edges where the fabrics have been cut).

Once the remaining edges are sewn, the fabric is engaged by a second cloth puller which stacks the fabric product on a table.

Once stacked on the table, the fabric product is turned inside out and is ready for use as a pillow sham. If desired, the pillow sham can be further enhanced by making other stitched lines into the product or by sewing borders or other decorative items on to the product.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures in which.

Figure 1:
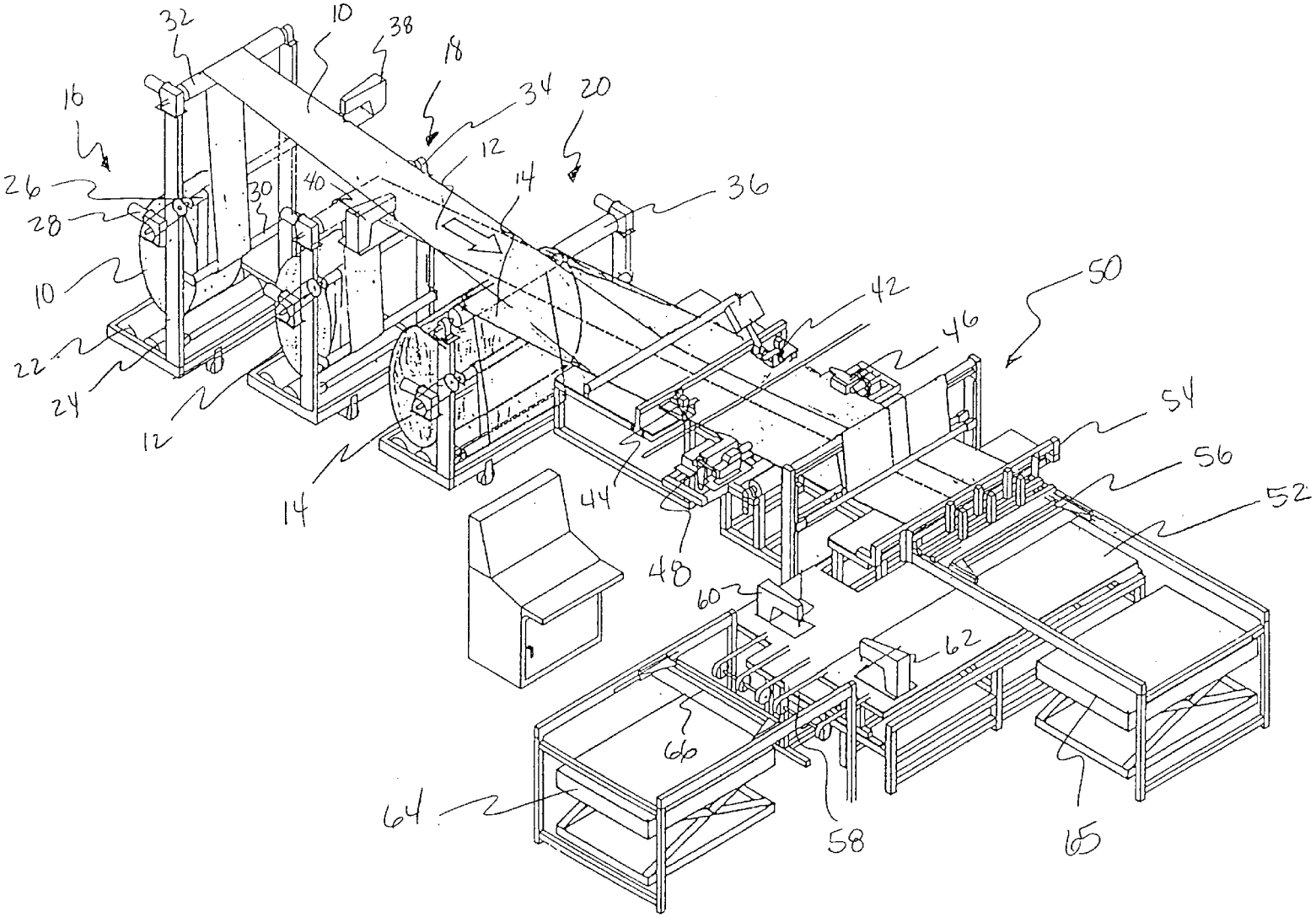
FIG. 1 is a perspective view of one embodiment of a cutting and sewing system made in accordance with the present invention.

Repeat use of reference characters in the present specification and drawings is intended to represent same or analogous features or elements of the invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process and to a system for forming fabric products and, in particular, for forming pillow shams. Of particular advantage, the system of the present invention is capable of taking one or more rolls of fabric and automatically and continuously converting the fabric into a pillow sham without having to make the fabric product in a step-wise manner.

In the past, the present inventors have developed and invented various folding and sewing devices. For instance, such devices are disclosed in U.S. Pat. No. 5,572,940 entitled "FOLDING AND SEWING APPARATUS", which is incorporated herein by reference in its entirety, and in U.S. Pat. No. 5,704,304 entitled "LEVEL LINING APPARATUS AND METHOD" which is also incorporated herein by reference in its entirety. As will be described in more detail below, various features and aspects of the present inventors' prior work may be incorporated into the system of the present invention for creating various fabric products, such as pillow shams.

Referring in more detail to the drawings, FIG. 1 is a perspective view of a system for producing pillow shams from one or more rolls of material. In the embodiment illustrated, the system has been designed to process three rolls of material 10, 12 and 14. In particular, roll of material 10 is carried on a let off generally 16, roll of material 12 is carried on a let off generally 18, while roll. of material 14 is carried on a let off generally 20. Let offs 16, 18 and 20 are all similarly constructed.

As shown with respect to let off 16, each let off includes a pair of idle rollers 22 and 24 which permit the roll of cloth 10 to be rotated when the cloth is pulled by a power driven roll 26 which has a friction covering thereon. Power driven roll 26 is driven by an electric motor 28. In particular, electric motor 28 is a variable speed driven motor which is under the control of a dancer roll 30. Dancer roll 30 is permitted to move up and down responsive to variations in tension in the cloth extending therearound. As dancer roll 30 moves up and down, it varies the adjustment on a potentiometer that in turn varies the voltage applied to the motor drive board for varying the let off speed of the cloth.

In order to ensure that fabrics 10, 12 and 14 are fed to the system simultaneously and under constant tension, let offs 16, 18 and 20 can be equipped with a level lining apparatus as described in U.S. Pat. No. 5,704,304 as referenced above.

For instance, in order to ensure that fabrics 10, 12 and 14 are each fed into the system under constant tension and uniformly, the dancer rolls (such as 30) can have a predetermined weight. For instance, each dancer roll can weigh 10 pounds which is then supported by each respective cloth.

Some or all of the let offs 16, 18 and 20 can further include a second power driven roll 32, 34 and 36 respectively. Each power driven roll is in operative association with a torque supplying device. For instance, power driven roll 32 is in association with a torque supplying device 34. Each torque supplying device selectively supplies a predetermined amount of torque to each corresponding power driven roll. The power driven roll in combination with the torque supplying device is added to each let off in order to adjustably place each corresponding fabric under a different tension in comparison to the other fabrics being fed to the system for feeding the fabrics simultaneously and in alignment.

In this arrangement, the power driven rolls can apply a continuous torque to the fabric for placing in equilibrium the rate at which the fabrics are fed to the system. The torque supplying device works in combination with the weighted dancer roll for adjustably placing a particular total amount of tension in the fabric. In particular, the torque supplying device, which is fully adjustable, compensates for the amount of tension being applied to the fabric by the dancer roll.

The level lining apparatus as described herein feeds all of the fabrics at a constant tension. However, different amounts of tension are applied to each fabric in comparison to the other fabrics in order to compensate for differences in the makeup of the fabrics (such as weight, denier, texture, etc.) and for the different effects that the sewing and cutting apparatus have on the fabrics.

One type of torque supplying device that can be used in the present invention includes an electric motor in operative association with a hysteresis clutch. A belt can be used to interconnect the motor with the hysteresis clutch while a similar belt can interconnect the clutch with the power driven roll. The hysteresis clutch can include an adjustable control device for increasing or decreasing the amount of torque applied to the roller.

In the embodiment illustrated in FIG. 1, the system includes three let offs 16, 18 and 20. It should be understood, however, that the system can accommodate more let offs if desired. For instance, in an alternative embodiment, further let offs can be included for inserting a quilted inner lining material into the pillow sham.

As fabrics 10, 12 and 14 are fed to the system of the present invention, edge cutting devices can be included for cutting each fabric to a desired width. Alternatively, the fabrics can be pre-sized prior to being fed to the system.

In the embodiment illustrated in FIG. 1, as the fabrics are fed to the system, the first operation that takes place is for a hem to be formed along an edge of fabric 10 and along an edge of fabric 12. In particular, hems are formed along the inside edges of fabric 10 and fabric 12 where fabric 10 and fabric 12 overlap as will be described in more detail hereinafter.

Not shown, in order to form a hem in fabrics 10 and 12, the system can include edge folding and positioning stations which are illustrated and described in U.S. Pat. No. 5,572,940 as referenced above. The purpose of the edge folding and positioning stations is to uniformly fold each edge of both fabrics so that a straight and uniform width hem can be subsequently sewn into the edges of both cloths.

Once the inner edge of fabric 10 and the inner edge of fabric 12 are folded, each fabric is fed to separate sewing heads 38 and 40 respectively. Sewing heads 38 and 40 can be combined with a cloth advancer that feeds each fabric through the sewing head. Preferably, each sewing head is designed so that the fabric is only pulled through the sewing head when a needle contained in each sewing head is out of the fabric. Again, such sewing heads are disclosed and described in U.S. Pat. No. 5,572,940 referenced above.

Once hems are stitched into fabrics 10 and 12, the fabrics are superimposed upon each other for further processing. In particular, as shown, back panels 10 and 12 are superimposed onto face fabric 14. Further, back panel 10 overlaps a portion of back panel 12.

Figure 2:
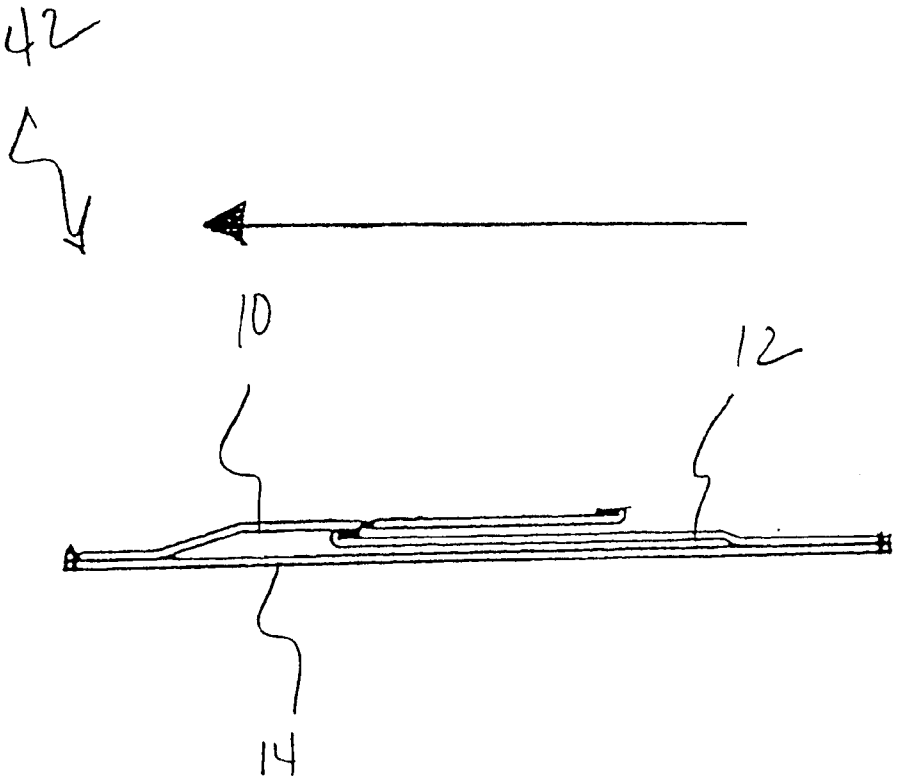
FIG. 2 is a side view of a pillow sham made in accordance with the present invention.
Figure 3:
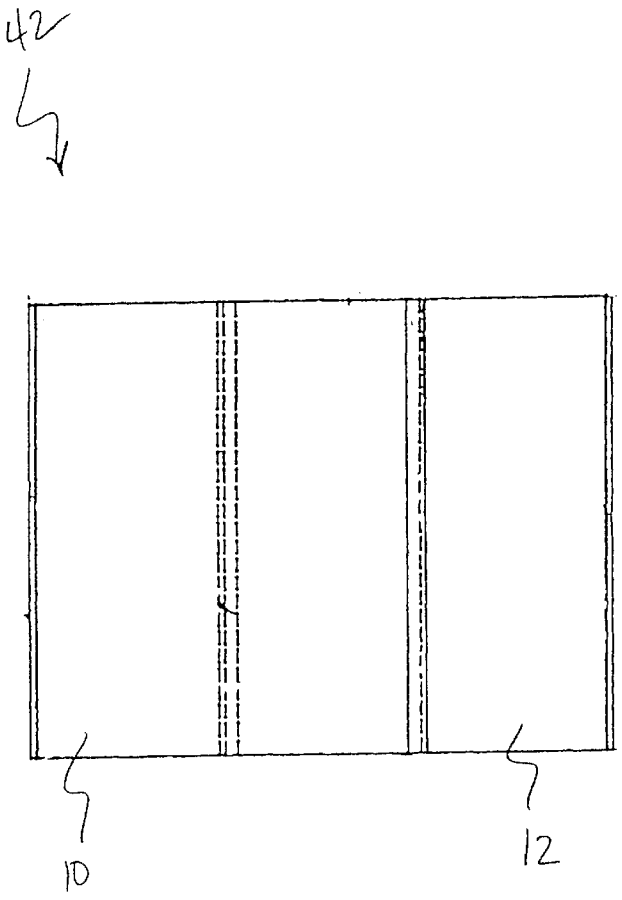
FIG. 3 is a plan view of the pillow sham illustrated in FIG. 2.

In order to better understand the manner in which the fabric plies are combined, reference is now made to FIGS. 2 and 3 in which an example of a fully constructed pillow sham generally 42 made in accordance with the present invention is shown. Referring particularly to FIG. 2, face fabric 14 is shown in combination with back panels 10 and 12. As shown in FIG. 3, pillow sham 42 generally has a rectangular shape and has a size sufficient to receive a pillow. Specifically, a pillow is inserted between back panels 10 and 12 where the panels overlap. The overlapping portion thus provides a place for the pillow to be inserted into the sham while at the same time preventing the pillow from being released.

Referring back to FIG. 1, in order to form a pillow sham as illustrated in FIGS. 2 and 3, the system next can include a first edge folding and positioning station 42 and a second edge folding and positioning station 44 positioned on opposite edges of the layers of fabric 10, 12 and 14. Edge folding and positioning stations 42 and 44 are as described above and in U.S. Pat. No. 5,572,940 and can be added for placing a fold in the edge of the fabrics. Edge folding and positioning stations 42 and 44 are optional and can be added to the system if desired.

From edge folding and positioning stations 42 and 44, the plies of fabric are then fed to sewing heads 46 and 48 respectively. Sewing heads 46 and 48 stitch together the vertical or outer edges of the fabrics. In particular, sewing head 46 stitches together face fabric 14 to back panel 12, while sewing head 48 stitches together face fabric 14 to back panel 10.

Once the back panels have been stitched to the face fabric, the superimposed fabrics are then fed to an accumulator generally 50. Accumulator 50 accumulates a fabric reserve which is fed to a cutting table 52.

Provided on cutting table 52 is a length cutter 54 which cuts the fabric layers from one side to the other. Cutting table 52 also includes a cloth puller 56, which is suspended above cutting table 52 on a pair of guide rails.

One example of a length cutter 54 and a cloth puller 56 are described in detail in U.S. Pat. No. 5,572,940 as referenced above. During operation, cloth puller 56 grips the end of fabrics 10, 12 and 14 and pulls the fabrics a predetermined distance over cutting table 52. Once cloth puller 56 reaches a predetermined length, length cutter 54 cuts the fabrics. Once cut, the plies of fabric are allowed to rest on top of table 52.

From cutting table 52, in one embodiment, the cut fabric plies are then shifted 90° by a conveyor 58 through sewing heads 60 and 62. Sewing heads 60 and 62 stitch together the remaining free edges of the pillow sham. If desired, further edge folding and positioning stations can also be placed on the system prior to sewing heads 60 and 62 for forming a hem into the remaining edges of the fabric plies.

Of particular importance and advantage, the system of the present invention is designed so that back panel 10, which overlaps back panel 12, is fed first through sewing heads 60 and 62. For instance, referring to FIG. 2, the arrow indicates the direction in which pillow sham 42 is transferred through sewing heads 60 and 62. In this manner, back panel 10 remains folded over back panel 12 as pillow sham 42 is fed through the sewing machines. If pillow sham 42 are fed through sewing machines 60 and 62 in a reverse direction, there may be a tendency for back panel 10 to flip over and not become stitched to face fabric 14.

Once the remaining edges of the pillow sham are stitched together, a second cloth puller 66 then grabs an end of the pillow sham and places it upon a collection table 64. Once collected on table 64, the pillow sham can be turned inside out and used as desired or can be fed through further finishing stations in order to further embellish the appearance of the pillow sham. For instance, further stitch lines can be sewn into the pillow sham or borders and other decorative items can be stitched to the sham. For instance, attached ruffles or other edge enhancement materials may be sewn to the pillow sham. In one embodiment, for instance, all sewing heads may not be activated in the system so that the edges of the sham can be sewn together with edge enhancement techniques, such as cord piping. In this embodiment, instead of collecting the pillow sham on table 64, the sham can be fed directly across the transfer area to a table/stacker 65 and collected.

The above described system is generally directed to processing multiple rolls of fabric and forming a pillow sham. In an alternative embodiment of the present invention, however, only a single roll of material is used to form the sham. In this embodiment, instead of separate back panels being superimposed upon a face fabric, a roll of material is folded into a tube as it is processed through the system for forming the sham.

Figure 4:
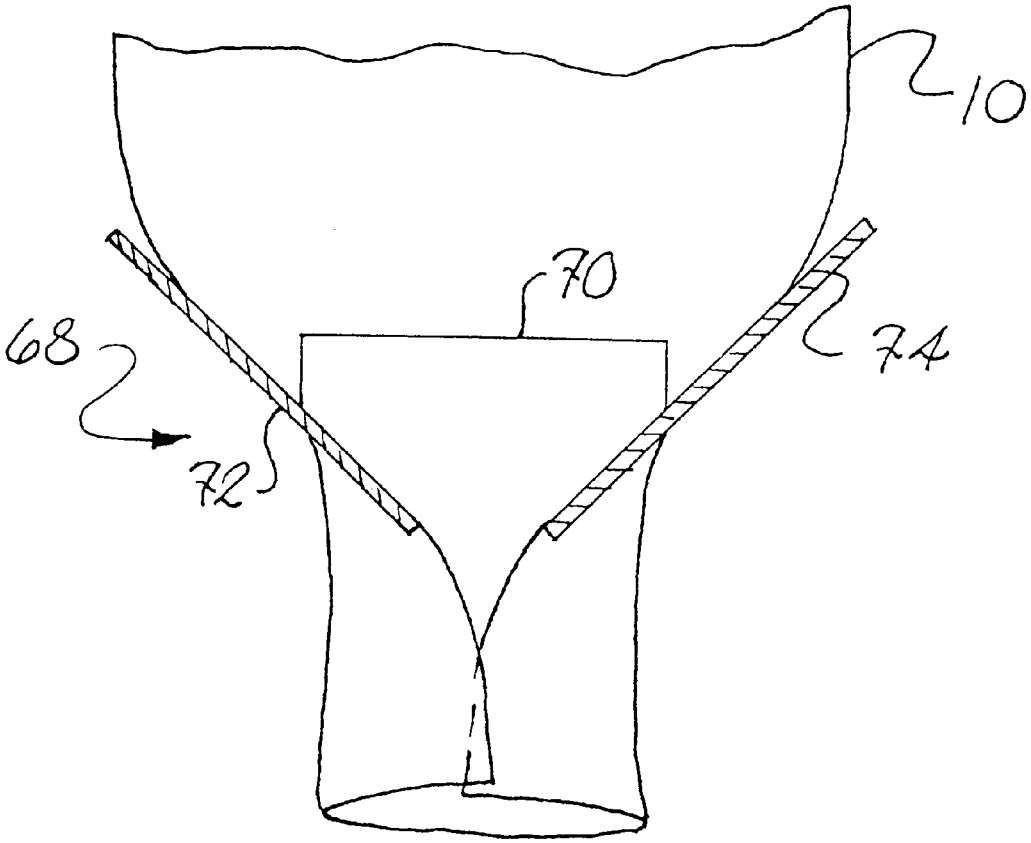
FIG. 4 is a perspective view of a folding device for use in the system of the present invention.
Figure 5:
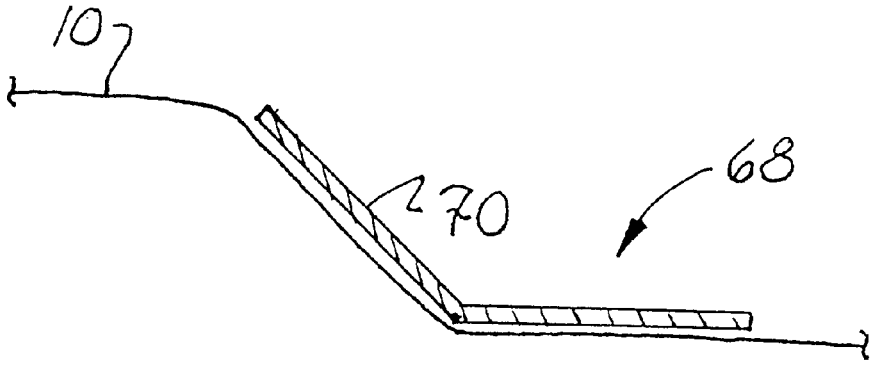
FIG. 5 is a cross sectional view of the folding device illustrated in FIG. 4.

For instance, referring to FIGS. 4 and 5, a fabric folding station generally 68, which can be included in the system, is illustrated that receives and folds fabric 10. Specifically, fabric folding station 68 would be positioned within the system as illustrated in FIG. 1 prior to accumulator 50. As shown in FIGS. 4 and 5, fabric folding station 68 includes a folding die 70 that is angularly shaped. Fabric 10 is fed underneath and then around fabric die 70. A pair of folding rods 72 and 74 are positioned so as to guide and fold the edges of the fabric. In particular, the edges of the fabric are folded over folding die 70 so as to overlap, similar to the manner in which back panel 10 overlaps back panel 12 as shown in FIG. 1.

In this embodiment, edge folding and positioning stations 42 and 44 and sewing heads 46 and 48 are optional.

These and other modifications and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention as described above.

What is claimed is:

1. A process for automatically forming a pillow sham comprising in the steps of:

providing a face fabric from a first roll of material, a first backing layer from a second roll of material, and a second backing layer from a third roll of material;

placing said first backing layer and said second backing layer on said face fabric to form a fabric composite, said first backing layer and said second backing layer overlapping along interior vertical edges on said face fabric, said fabric composite including a first vertical edge, a second vertical edge, and a leading edge;

stitching said first backing layer to said face fabric along said first vertical edge;

stitching said second backing layer to said face fabric along said second vertical edge;

cutting said fabric composite to a determined length thereby forming a trailing edge;

stitching said fabric composite together along said leading edge;

stitching said fabric composite together along said trailing edge to form a pillow sham having an opening for receiving a pillow in between said overlapping edges of said first and second backing layers.

2. A process as defined in claim 1, further comprising the step of forming a sewn hem along each of said interior vertical edges of said first and second backing layers.

3. A process as defined in claim 1, further comprising the step of forming a hem along said first and second vertical edges prior to stitching said edges.

4. A process as defined in claim 1, further comprising the step of turning said fabric composite inside out after said leading edge and said trailing edge are stitched.

5. A process as defined in claim 1, further comprising the step of forming a hem along said leading edge and said trailing edge prior to stitching.

6. A process as defined in claim 1, wherein said face fabric, said first backing layer, and said second backing layer are maintained under constant tension until said composite fabric is cut.

7. A process as defined in claim 1, wherein said first and second backing layers when placed on said face fabric have substantially the same width as the face fabric.

8. A process as defined in claim 1, wherein the rolls of material are transported through a fabric processing system when forming said pillow sham, said fabric processing system shifting said fabric composite ninety degrees after the composite is cut in order to stitch the leading and trailing edges together.

9. A process for automatically forming a pillow sham comprising the steps of:

providing a face fabric from a roll of material, said face fabric having a first vertical edge and a second vertical edge;

folding said first and second vertical edges over said face fabric to form a fabric composite having a tube-like structure, said second vertical edge overlapping said first vertical edge;

cutting said fabric composite to a determined length, said cut fabric composite including a first horizontal edge and a second horizontal edge;

stitching said fabric composite together along said first horizontal edge;

stitching said fabric composite together along said second horizontal edge to form a pillow sham having an opening for receiving a pillow in between said overlapping vertical edges of said face fabric.

10. A process as defined in claim 9, further comprising the step of turning said fabric composite inside out after stitching said horizontal edges.

11. A process as defined in claim 9, further comprising the step of forming a sewn hem along each of said first and second vertical edges prior to folding said vertical edges and forming said tube-like structure.

12. A process as defined in claim 9, wherein first and second fold lines are formed where said first and second vertical edges are folded over said face fabric and wherein said process further comprises the step of stitching said fabric composite together along each of said first and second fold lines.

13. A process as defined in claim 9, further comprising the step of superimposing a liner fabric from a roll of material onto said face fabric during formation of said pillow sham.

14. An apparatus for automatically producing a pillow sham comprising:

a first roll let off for supporting and feeding a face fabric, a second roll let off for supporting and feeding a first backing layer and a third roll let off for supporting and feeding a second backing layer, said roll let offs being positioned such that said first backing layer and said second backing layer are placed on said face fabric to form a fabric composite, said first backing layer and said second backing layer overlapping along interior edges;

a first sewing head for stitching along a first vertical edge of said fabric composite;

a second sewing head for stitching along a second vertical edge of said fabric composite;

a cutting station configured to cut predetermined lengths of said fabric composite;

a third sewing head for stitching along a first horizontal edge of a cut piece of fabric composite;

a fourth sewing head for stitching along a second horizontal edge of said cut piece of fabric composite; and a transporting device for transporting said cut piece of fabric composite from said cutting station to said third and said fourth sewing heads.

15. An apparatus as defined in claim 14, wherein said cutting station includes a cloth puller and a length cutter, said cloth puller for engaging and pulling an end of said fabric composite, a predetermined length, said length cutter for cutting said predetermined length of said composite fabric.

16. An apparatus as defined in claim 14, further comprising a pair of edge folding and positioning units positioned to receive said vertical edges of said fabric composite, wherein said edge folding and positioning units form a vertical fold along each of said vertical edges, said units maintaining said fold at a predetermined width as said fabric composite is fed to said first and second sewing heads.

17. An apparatus as defined in claim 14, wherein said transporting device comprises a plurality of endless belts that engage and transport said cut predetermined lengths of said fabric composite to said third and fourth sewing heads.

18. An apparatus for automatically producing a pillow sham comprising:

a first roll let off for supporting and feeding a face fabric, said face fabric including a first vertical edge and second vertical edge;

a pair of edge folding and positioning units positioned to receive said first and second vertical edges of said face fabric as the face fabric is unwound from said let off, wherein said edge folding and positioning units form a vertical fold along the edges of the face fabric;

first and second sewing heads for stitching along said first and second vertical edges of said face fabric after said vertical edges have been folded by said pair of edge folding and positioning units;

a fabric folding station for receiving said face fabric, said fabric folding station being configured to fold said first and second vertical edges over said face fabric to form a tube-like fabric composite, said first vertical edge overlapping said second vertical edge;

a cutting station for cutting predetermined lengths of said fabric composite, said cut fabric composite including a first horizontal edge and a second horizontal edge; and third and fourth sewing heads for stitching along said first horizontal edge and said second horizontal edge thereby forming a pillow sham.

19. An apparatus as defined in claim 18, wherein said cutting station includes a cloth puller and a length cutter, said cloth puller for engaging and pulling an end of said fabric composite a predetermined length, said length cutter for cutting said predetermined length of said composite fabric.

20. An apparatus as defined in claim 18, further comprising a transporting device for transporting said cut fabric composite from said cutting station to said third and fourth sewing heads.

21. An apparatus as defined in claim 20, wherein said transporting device comprises a plurality of endless belts.

* * * * *